United States Patent [19]

Bryant

[11] 4,284,414

[45] Aug. 18, 1981

[54] MIXED ALKYL ESTERS OF INTERPOLYMERS FOR USE IN CRUDE OILS

[75] Inventor: Charles P. Bryant, Euclid, Ohio

[73] Assignee: The Lubrizol Corporation, Wickliffe, Ohio

[21] Appl. No.: 196,975

[22] Filed: Oct. 14, 1980

[51] Int. Cl.[3] ..... C10G 73/38

[52] U.S. Cl. ..... 44/62; 252/56 D; 208/370

[58] Field of Search ..... 252/56 D; 44/62; 208/370

[56] References Cited

U.S. PATENT DOCUMENTS

| | | | |
|---|---|---|---|
| 3,536,461 | 10/1970 | Mueller et al. | 44/62 |
| 3,574,575 | 4/1971 | Gee et al. | 44/62 |
| 3,879,177 | 4/1975 | Andress, Jr. | 44/62 |
| 3,910,856 | 10/1975 | Kruka et al. | 208/370 |
| 4,160,459 | 7/1979 | Sweeney | 44/62 |

*Primary Examiner*—Delbert E. Gantz
*Assistant Examiner*—Irving Vaughn
*Attorney, Agent, or Firm*—Ronald L. Lyons; William H. Pittman; Raymond F. Keller

[57] ABSTRACT

Mixed alkyl esters made by reacting a mixture of two or more of certain monohydric alcohols with interpolymers derived from (i) $\alpha,\beta$-unsaturated dicarboxylic acids or derivatives thereof and (ii) vinyl aromatic monomers having up to 12 carbon atoms are useful modifiers for crude oils.

9 Claims, No Drawings

MIXED ALKYL ESTERS OF INTERPOLYMERS FOR USE IN CRUDE OILS

BACKGROUND OF THE INVENTION

This invention relates to the use of mixed alkyl esters made by reacting two or more of certain monohydric alcohols with interpolymers which contain units derived from (i) $\alpha,\beta$-unsaturated dicarboxylic acids, or derivatives thereof and (ii) vinyl aromatic monomers having up to 12 carbon atoms in crude oils. Minor amounts of the mixed alkyl esters are useful for modifying the fluidity and flow characteristics of crude oils, and more particularly, for improving the pipeline pumpability of crude oils.

Crude oils are transported over long distances through pipelines, and the pumpability of the crude oils through the pipelines is an important consideration. Most crude oils are characterized by their high natural pour points thereby requiring the addition of pour point depressants and fluidity improves as an aid to pipeline pumpability. Various materials have been suggested in the prior art as fluidity improvers in liquid hydrocarbons which are highly desirable and useful. However, many of the known fluidity improvers have not proved entirely satisfactory in improving the fluidity characteristics of a wide variety of liquid hydrocarbons. Some fluidity improvers have been found to be effective in certain types of oils while exhibiting more limited improvement in other types of oils. More specifically, some of the pour point depressants which have heretofore been used to control the pour point of distillate fuels and lubricants have been found to be either ineffective or to show only slight improvement in lowering the pour point of crude oils.

In addition to lowering the pour point of crude oils, it also is important to modify other properties of crude oils in order to improve the pipeline pumpability of the crudes. For example, it is desirable to lower the plastic viscosity and the yield value of the crude oils which are to be transported through pipelines. The yield value can be defined as the minimum force required to "move" the crude oil from a static position at a given temperature. Thus, yield value measurements assist in predicting the ease of re-starting a shut-down pipeline.

As mentioned above, some fluidity modifiers have proved effective in certain types of oils while exhibiting more limited improvement in other types. For example, in U.S. Pat. No. 3,536,461, pour point depressants comprising esters of a styrene and maleic anhydride polymer and longchain fatty alkanols of 20 to 22 carbon atoms are reported to be effective to lower the pour point of both raw and hydrotreated shale oil. However, the corresponding ester derived from an alkanol containing 18 carbon atoms is effective in lowering the pour point only of shale oil which has been hydrotreated.

The use of esters of styrene-maleic anhydride copolymers in lowering the pour point of hydrocarbon oils including crude oils and residual oils is described also in U.S. Pat. No. 3,574,575. The patentees report that there is no significant improvement in the fluidity characteristics of the crude oils tested (demonstrated by pour point data) when the esters are derived from alkanols which contain less than 20 carbon atoms in the alkyl portion. In this patent, the esters containing at least 20 carbon atoms were compared to esters containing 18 carbon atoms, namely, the di-1-octadecyl ester of styrene-maleic anhydride copolymer.

An improvement in the process for producing waxy crude oil from wells is described in U.S. Pat. No. 3,879,177 wherein an agent is added to the crude which is prepared by esterifying a copolymer of maleic anhydride and vinyl methyl ether with docosanol or a mixture of alcohols containing 18 to 24 carbon atoms. The improved process is reported to effectively inhibit the crystallization of wax from a waxy crude oil.

SUMMARY OF THE INVENTION

Crude oil compositions are described which are characterized as having improved fluidity characteristics, and these compositions contain a minor amount of at least one mixed alkyl ester made by reacting;

(A) interpolymers having a RSV in a range from about 0.1 to about 2.0 which contain units derived from (i) at least one $\alpha,\beta$-unsaturated dicarboxylic acid, or derivative thereof and (ii) one or more vinyl aromatic monomers having up to about 12 carbon atoms, the molar ratio of units of (i) to (ii) being from about 1:1 to about 1:3, with (B) a mixture of two or more monohydric alkanols containing from 18 to 40 carbon atoms, at least one of the alkanols containing 18 carbon atoms.

Crude oil compositions containing these mixed alkyl esters are characterized by reduced pour points, plastic viscosities and yield values.

DESCRIPTION OF THE PREFERRED EMBODIMENTS

The mixed alkyl esters of this invention are made by reacting (A) interpolymers having a RSV in a range of from about 0.1 to about 2.0 (preferably 0.3 to about 1.8) which contain units derived from (i) at least one $\alpha,\beta$-unsaturated dicarboxylic acid or derivative thereof and (ii) one or more vinyl aromatic monomers individually having up to about 12 carbon atoms, the molar ratio of units of (i) to (ii) being from about 1:1 to about 1:3 (preferably about 1:1), with (B) a mixture of two or more monohydric alkanols (preferably primary alkanols) containing from 18 to 40 carbon atoms, at least one of the alkanols containing 18 carbon atoms. At least one equivalent weight of alkanol is used per equivalent weight of interpolymer in the preparation of the esters since the diester composition is desired. Accordingly, the interpolymers are at least about 90% esterified with the two or more monohydric alkanols, more preferably at least about 95% esterified. Crude oil compositions of this invention contain a minor amount (i.e., up to about 6% by weight of the total composition) of the mixed alkyl ester sufficient to modify the viscosity of such oils.

One aspect of this invention is the molecular weight of the interpolymer before esterification with the two or more monohydric alkanols of (B) above. The molecular weight is expressed herein and in the appended claims in terms of the "reduced specific viscosity" of the interpolymers which is a recognized means of expressing the molecular size of a polymeric substance. As used herein, and in the appended claims, the reduced specific viscosity (abbreviated as RSV) is the value obtained in accordance with the formula:

$$\text{RSV} = \frac{\text{relative viscosity} - 1}{\text{concentration}}$$

wherein the relative viscosity is determined by measuring, by means of a dilution viscometer, the viscosity of a solution of 1 gram of the interpolymer in 100 milliliters of acetone and the viscosity of acetone at 30°±0.02° C. For the purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, "Principles of Polymer Chemistry" (1953 edition) pages 208 and following.

Mixtures of two or more compatible (i.e., nonreactive to one another) interpolymers which are separately prepared are contemplated herein for use in the esterification reaction, if each has a RSV as above described. Thus, as used herein, and in the appended claims, the terminology "interpolymer" refers to either one separately prepared interpolymer or a mixture of two or more of such interpolymers. A separately prepared interpolymer is one in which the reactants and/or reaction conditions are different from the preparation of another interpolymer.

The interpolymers are copolymers, terpolymers, and other interpolymers of α,β-unsaturated dicarboxylic acids or derivatives thereof, or mixtures of two or more of any of these, and one or more vinyl aromatic monomers having up to 12 carbon atoms. The derivatives of the dicarboxylic acid are derivatives which are polymerizable with the monoolefinic compound, and as such, may be the esters and anhydrides of the acids. Copolymers of maleic anhydride and styrene are especially suitable, and such interpolymers having a RSV in the range from about 0.3 to about 1.8 (particularly 0.3 to about 0.9) are preferred.

Suitable α,β-unsaturated dicarboxylic acids, anhydrides or lower alkyl esters thereof useful in the preparation of the interpolymers include those wherein a carbon-to-carbon double bond is in an α,β-position to at least one of the carboxy functions (e.g., itaconic acid, anhydride or lower esters thereof) and preferably, in an α,β-position to both of the carboxy functions of the α,β-dicarboxylic acid, anhydride or the lower alkyl ester thereof (e.g., maleic acid, anhydride or lower alkyl esters thereof). Normally, the carboxy functions of these compounds will be separated by up to 4 carbon atoms, preferably 2 carbon atoms.

A class of preferred α,β-unsaturated dicarboxylic acid, anhydrides or the lower alkyl esters thereof, includes those compounds corresponding to the formulae:

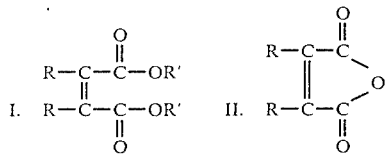

(including the geometric isomers thereof, i.e., cis and trans) wherein each R is independently hydrogen; halogen (e.g., chloro, bromo, or iodo); hydrocarbyl or halogen-substituted hydrocarbyl of up to about 8 carbon atoms, preferably alkyl, alkaryl or aryl; (preferably, at least one R is hydrogen); and each R′ is independently hydrogen or lower alkyl of up to about 7 carbon atoms (e.g., methyl, ethyl, butyl or heptyl). These preferred α,β-unsaturated dicarboxylic acids, anhydrides or alkyl esters thereof contain a total carbon content of up to about 25 carbon atoms, normally up to about 15 carbon atoms. Examples include maleic anhydride; benzyl maleic anhydride; chloro maleic anhydride; heptyl maleate; citaconic anhydride; ethyl fumarate; fumaric acid; mesaconic acid; ethyl isopropyl maleate; isopropyl fumarate; hexyl methyl maleate; phenyl maleic anhydride and the like. These and other α,β-unsaturated dicarboxylic compounds are well known in the art. Of these preferred α,β-unsaturated dicarboxylic compounds, maleic anhydride, maleic acid and fumaric acid and the lower alkyl esters thereof are preferred. Interpolymers derived from mixtures of two or more of any of these can also be used.

Suitable vinyl aromatic monomers of up to about 12 carbon atoms which can be polymerized with the α,β-unsaturated dicarboxylic acids, anhydrides or lower esters thereof are well known. The nature of the vinyl aromatic monomer is normally not a critical or essential aspect of this invention as these compounds serve primarily as a connective moiety for the α,β-unsaturated compounds in forming the interpolymers. The vinyl aromatic compounds include styrene and substituted styrenes such as α-halostyrenes, lower alkyl-substituted styrenes such as α-methylstyrenes, para-tert-butylstyrenes, α-ethylstyrenes, and para-lower alkoxy styrenes. Mixtures of two or more vinyl aromatic monomers can be used.

Particularly preferred mixed alkyl esters of this invention are those of interpolymers made by reacting maleic acid, or anhydride or the lower esters thereof with styrene. Of these particularly preferred interpolymers those which are made of maleic anhydride and styrene and have a RSV in the range of about 0.3 to about 0.9 are especially useful. Of these latter preferred interpolymers, copolymers of maleic anhydride and styrene having a molar ratio of the maleic anhydride to styrene of about 1:1 are especially preferred. They can be prepared according to methods known in the art, as for example, free radical initiated (e.g., by benzoyl peroxide) solution polymerization. Examples of such suitable interpolymerization techniques are described in U.S. Pat. Nos. 2,938,016; 2,980,653; 3,085,994; 3,342,787; 3,418,292; 3,451,979; 3,536,461; 3,558,570; 3,702,300; and 3,723,375. These patents are incorporated herein by reference for their teaching of the preparation of suitable maleic anhydride and styrene containing interpolymers. Other preparative techniques are known in the art.

The molecular weight (i.e., RSV) of such interpolymers can be adjusted to the range required in this invention, if necessary, according to conventional techniques, e.g., control of the reaction conditions.

The following examples serve to illustrate the preparation of the interpolymers used in this invention and are not intended as limiting thereof.

EXAMPLE A

A styrene-maleic interpolymer is obtained by reacting styrene (16.3 parts by weight) and maleic anhydride (12.9 parts) in a benzene-toluene solvent mixture (272.7 parts; weight ratio of benzene:toluene being 66.5:33.5) at 86° C. in a nitrogen atmosphere for 8 hours with a benzoyl peroxide (0.42 part) catalyst. The resulting product is a thick slurry of the interpolymer in the solvent mixture. To the slurry there is added mineral oil (141 parts) while the solvent mixture is being distilled off at 150° C. and then at 150° C. under a vacuum of 200 torr. A sample of the interpolymer isolated from the oil has a RSV of 0.69.

EXAMPLE B

An interpolymer is prepared by reacting (while maintaining the temperature between 99°-105° C.) styrene (536 parts) and maleic anhydride (505 parts) in toluene (7,585 parts) in the presence of a catalyst solution prepared by dissolving benzoyl peroxide (1.5 parts) in toluene (50 parts). The toluene is removed by vacuum stripping as mineral oil (2,228 parts) is added. The oil solution obtained in this manner contains 55.4% oil. The resulting interpolymer (free of oil) has a RSV of 0.42.

EXAMPLE C

The procedure of Example A is followed except that the interpolymer is prepared by reacting (while maintaining the temperature between 65°-106° C.) styrene (416 parts) and maleic anhydride (392 parts) in a benzene (2,153 parts) and toluene (5,025 parts) mixture in the presence of benzoyl peroxide (1.2 parts). The resulting interpolymer (free of oil) has a RSV of 0.45.

EXAMPLE D

The procedure of Example A is followed except that the interpolymer is obtained by reacting between 78°-92° C., styrene (416 parts) and maleic anhydride (392 parts) in a benzene (6,101 parts) and toluene (2,310 parts) mixture in the presence of benzoyl peroxide (1.2 parts). The resulting interpolymer (free of oil) has a RSV of 0.91.

EXAMPLE E

The procedure of Example A is followed except that the interpolymer is prepared by the following procedure: Maleic anhydride (392 parts) is dissolved in benzene (6,870 parts). To this mixture at 76° C. is added first styrene, (416 parts) then benzoyl peroxide (1.2 parts). The mixture is maintained at 80°-82° C. for 5 hours. The resulting interpolymer (free of oil) has a RSV of 1.24.

EXAMPLE F

The procedure of Example E is followed except that acetone (1,340 parts) is used in place of benzene as solvent and that azobis-isobutyronitrile (0.3 part) is used in place of benzoyl peroxide as catalyst.

EXAMPLE G

The procedure of Example A is followed except that the interpolymer is prepared as follows: To a solution of maleic anhydride (69 parts) in benzene (805 parts) at 50° C. there is added styrene (73 parts). The resulting mixture is heated to 83° C. and benzoyl peroxide (0.19 part) is added. The mixture is then maintained at 80°-85° C. The resulting interpolymer (free of oil) has a RSV of 1.64.

The esterification of interpolymers of this invention can be accomplished either by sequential or concurrent reaction with the two or more monohydric alkanols. Generally, it is preferred to react at least a major proportion (i.e. at least 50% by weight of the total weight of monohydric alkanols used) of the monohydric alkanols concurrently under esterification conditions in order to effect esterification. This concurrent esterification appears to enhance the ability of the mixed alkyl ester to be fluidized in solvent or diluents.

The esterification is conducted until at least about 90% (preferably at least 95%) of the carboxy functions of the interpolymers are esterified with the monohydric alkanols to form pendant ester groups. When starting with interpolymers which have units made from reacting the lower alkyl esters (e.g., $C_{1-7}C$) of the $\alpha,\beta$-unsaturated dicarboxylic acids, the esterification is conducted until at least about 90% of the total number of lower alkyl ester radicals are displaced, preferably at least about 95% or more with the two or more monohydric alkanols. This displacement can be conveniently effected by maintaining the esterification temperature in a range above boiling point of the lower alkanols resulting from the transesterification.

Esterification of the interpolymers can be accomplished by heating any of the interpolymers (having the requisite RSV) and the two or more monohydric alkanols under conditions typical for effecting esterification. Such conditions include, for example, a temperature of at least about 80° C., but more preferably from about 150° C. to about 350° C., provided that the temperature is maintained at a level below the decomposition of the reaction mixture or products thereof. Water or lower alcohol is normally removed as the esterification proceeds. These conditions may optionally include the use of a substantially inert, normally liquid, organic solvent or diluent such as mineral oil, toluene, benzene, xylene or the like and an esterification catalyst such as toluene sulfonic acid, sulfuric acid, aluminum chloride, boron trifluoride-triethylamine, methane sulfonic acid, hydrochloric acid, ammonium sulfate, phosphoric acid, sodium methoxide or the like. These conditions and variations thereof are well known in the art.

It is desirable that all the carboxy functions of the interpolymers be reacted with the alkanols. Generally, therefore, an excess of alkanols over the stoichiometric requirement for complete esterification of the carboxy functions is used. As a practical matter, however, complete esterification may be too difficult or time consuming and the esterification can be discontinued when at least about 90% and preferably at least 95% or higher of the carboxy functions are esterified. Moreover, excess (over stoichiometric requirement) monohydric alkanols or unreacted monohydric alkanols need not be removed as such alkanols can serve, for example, as diluent or solvent in the use of the mixed alkyl esters. Similarly, optional reaction media, e.g., toluene, need not be removed as they can similarly serve as diluent or solvent in the use of the mixed alkyl esters.

The mixtures of two or more monohydric alkanols which can be employed to prepare the mixed alkyl esters useful in this invention can comprise, for example, primary aliphatic alkanols containing from 18 to 30 or 40 carbon atoms. Preferably, the mixture will contain principally alkanols containing from 18 to 24 carbon atoms although smaller amounts of other alkanols may be present. More preferably, the alkanol mixture will comprise long-chain fatty alkanols containing principally 18 to 22 carbon atoms. These long-chain fatty alkanols include octadecanol, nonadecanol, eicosanol, heneicosanol, docosanol, tricosanol and other straight chain alkanols, especially 1-alkanols of 18 to 22 carbon atoms. Of course, commercially available alkanols and alkanol mixtures are contemplated herein and these commercial alkanols may comprise minor amounts of other alcohols which, although not specified herein, do not detract from the major purposes of this invention. As mentioned above, it is one of the essential features of this invention that at least one of the alkanols in the alkanol mixture must contain 18 carbon atoms. The presence of the 18 carbon atom alkanol in the mixture results in the formation of esters which provide improved flow characteristics when added to crude oils. It is preferred that the amount of $C_{18}$ alkanol in the mixture be at least 3 mole percent and more preferably at least about 15 and up to about 40 mole percent.

Examples of some preferred monohydric alkanol mixtures suitable for forming ester radicals having continuous unbranched carbon chains of at least 18 carbon atoms include the commercially available Alfol 20+ alkanols and the Alfol 22+ alkanols marketed by Continental Oil Corporation. The Alfol 20+ alkanols, for instance, are mixtures of $C_{18}$–$C_{28}$ primary alkanols having mostly, on an alkanol basis, $C_{20}$ alkanols as determined by GLC (gas-liquid chromatography). The Alfol 22+ alkanols are $C_{18}$–$C_{28}$ primary alkanols having mostly, on an alkanol basis, $C_{22}$ alkanols as determined by GLC. These Alfol alkanols can contain a fairly large percent (e.g., up to about 40% by weight) of paraffinic compounds. These paraffinic compounds can be removed before esterification although such removal is not necessary. Other commercially available alkanol mixtures useful in this invention include mixtures containing alkanols with 18 to 22 carbon atoms such as those available from Ashland Oil ("Adol 60") and Henkel.

Generally, stoichiometric amounts or an excess of the long-chain fatty alkanol is used in the esterification reaction. Acid catalysts such as hydrochloric acid, sulfuric acid, p-toluene sulfonic acid etc. increase the efficiency of the esterification reaction.

The foregoing description is intended to set forth features of this invention to those skilled in the art to which the invention pertains. Obvious variations of this invention will occur to those in the art based on the foregoing description and the following examples. These variations are intended as part of this invention.

Unless otherwise indicated, all parts and percentages in the following examples are by weight.

EXAMPLE 1

A mixture of 561 parts of a behenyl alcohol mixture available from Henkel (a mixture of 17.4 mole percent of $C_{18}$ primary alkanol, 15.6 mole percent of $C_{20}$ primary alkanol and 67 mole percent of $C_{22}$ primary alkanol), and 668 parts of the interpolymer oil solution of Example B is heated to a temperature of about 105° C. over a period of 3.5 hours in a nitrogen atmosphere. Methane sulfonic acid (5.1 parts of a 70% aqueous solution) is added at this temperature in 6 minutes whereupon the temperature is raised to about 150° C. over a period of about 50 minutes and 60 parts of toluene is added to maintain reflux. The solution is maintained at 150°–156° C. for 5.5 hours. An additional 7 parts of methane sulfonic acid solution is added over a period of about 9 minutes. The mixture is maintained at 150°–155° C. for about 9 hours, and some water is removed by distillation.

The reaction mixture is then stripped at 130°–155° C. for 1 hour under a vacuum of about 10 torr. The residue is the desired product having a neutralization number of phenolphthalein of 3.0 acid and to bromphenol blue of 1.9 acid (both as determined by ASTM Method D 974).

EXAMPLE 2

To 375 parts of the alcohol mixture of Example 1 is added 445 parts of the interpolymer oil solution of Example B, and this mixture is heated up to a temperature of about 105° C. over a period of 3 hours in a nitrogen atmosphere. Sulfuric acid (1.4 parts, 93%) is added at this temperature over a period of about 6 minutes followed by heating of the mixture to 150° C. over a period of about 40 minutes. Toluene (40 parts) is added, and the solution is maintained at a temperature of about 150°–155° C. for 5.5 hours with a nitrogen purge. An additional 1.9 parts of sulfuric acid is added at this temperature in 6 minutes, and the reaction mixture is maintained at 150°–155° C. for 9.5 hours while removing water by distillation.

An additional gram of sulfuric acid is added, and the mixture is again maintained at 150°–155° C. for 3 hours. The reaction mixture then is stripped at 130°–155° C. over a period of 1 hour under a vacuum of 10 torr. The residue is the desired product. The product obtained in this manner has a neutralization number to phenolphthalein of 2.9 acid and to bromphenol blue of 0.9 acid.

EXAMPLE 3

The procedure of Example 2 is repeated except that the mixture of fatty alkanols is composed of 36 parts of the alcohol mixture of Example 1 and 10.8 parts of 1-octadecanol from Eastman, and 8.1 parts of methane sulfonic acid solution is used as catalyst.

EXAMPLE 4

The procedure in Example 2 is repeated except that the mixture of fatty alkanols is composed of 54.3 parts of 1-octadecanol from Eastman and a commercial mixture from Ashland Chemicals of 10.5 parts of 1-octadecanol, 60.5 parts of 1-eicosanol and 247 parts of docosanol.

EXAMPLE 5

A mixture (238 parts) of fatty alkanols composed of 0.317 mole of 1-octadecanol, 0.09 mole of 1-eicosonal and 0.385 mole of docosanol is heated with 297 parts of the interpolymer oil solution of Example B to a temperature of 105° C. over a period of 5 hours under nitrogen. Methane sulfonic acid (2.3 grams of 70% aqueous solution) is added at this temperature over a period of about 6 minutes whereupon the mixture is heated to 150° C. followed by the addition of 50 grams of toluene. The reaction mixture is heated at reflux at 150°–156° C. for 5.75 hours, and water is removed. An additional 3.2 grams of methane sulfonic acid solution is added at this temperature over a period of about 12 minutes, and the mixture is refluxed for 11 additional hours while removing water. The mixture then is stripped at 130°–155° C. for 1 hour under a vacuum of 10 torr. The residue is the mixed alkyl ester having a neutralization number to phenolphthalein of 2.7 acid and to bromphenol blue of 1.4 acid.

EXAMPLE 6

A mixture of 185 parts of Alfol 22+ alkanols available from Continental Oil Corporation (composed of 27% wax and 73% fatty alkanols consisting of 8 mole percent of $C_{20}$, 51 mole percent of $C_{22}$, 25 mole percent of $C_{24}$, 10 mole percent of $C_{26}$ and 6 mole percent of higher alkanols), 124 parts of the alcohol mixture of Example 1 and 307 parts of the interpolymer oil solution of Example B is heated with stirring under nitrogen to a temperature of 105° C. over a period of about 40 minutes. Methane sulfonic acid (2.3 parts of a 70% aqueous solution) is added over a period of 6 minutes and the mixture is heated to 150° C. over a period of about 40 minutes whereupon 50 parts of toluene is added. The mixture is refluxed at 150°-156° C. for 5.25 hours under nitrogen while removing water. An additional 3.2 grams of methane sulfonic acid solution is added over a period of 12 minutes, and this mixture is refluxed at 150°-156° C. for an additional 11.5 hours under nitrogen while removing water.

While holding the reaction temperature at about 150°-130° C., there is added an additional 17 parts of Alfol 22+ and 11 parts of the behenyl alcohol followed by the additon of 2.3 parts of methane sulfonic acid solution. The mixture was heated to 150° C. and maintained at this temperature for 5.25 hours while removing additional water. The reaction mixture is stripped at about 155° C. under a vacuum of about 10 torr. The residue is the desired mixed alkyl ester having a neutralization number to phenolphthalein of 4.0 acid and to bromphenol blue of 0.5 acid.

EXAMPLE 7

The procedure of Example 6 is repeated with the exception that 307 parts of the interpolymer oil solution of Example B, 323 parts of Alfol 22+, 47 parts of 1-octadecanol (Eastman), 9 parts of methane sulfonic acid solution and 50 parts of toluene are utilized in the reaction. The product obtained in this manner has a neutralization number to phenolphthalein of 4.4 acid and to bromophenol blue of 0.8 acid.

EXAMPLE 8

A mixture of 371 parts of Alfol 22+ and 297 parts of the oil solution of Example B is heated to a temperature of 105° C. over a period of 4.5 hours under nitrogen whereupon 2.3 parts of methane sulfonic acid (70% solution) is added over a period of 6 minutes. The mixture is heated to a temperature of 150° C. in 40 minutes, and 50 parts of toluene is added to maintain reflux conditions. The mixture is refluxed for an additional 5.75 hours at a temperature of between about 150°-156° C. while removing water. An additional 3.2 parts of methane sulfonic acid solution is added and the mixture is refluxed an additional 11.5 hours. The reaction mixture is stripped at 130°-155° C. over a period of 1 hour under a vacuum of 10 torr, and the residue is cooled.

To 332 parts of the above residue (94% esterified), there is added 9.72 parts of 1-octadecanol at 110° C. over a period of 6 minutes under nitrogen. Methane sulfonic acid (1.2 parts of an aqueous solution) is added in 6 minutes at 120° C. The mixture then is heated to a temperature of 150° C. and refluxed at 150°-156° C. for 5 hours. During this period, approximately 20 parts of toluene is added to maintain reflux. The reaction mixture is stripped at 130°-155° C. over a period of 1 hour under vacuum at 10 torr. The residue is the desired product having a neutralization number to phenolphthalein of 3.1 acid and to bromphenol blue of 0.5 acid.

The above-described mixed alkyl esters are suitable for modifying the flow characteristics of liquid hydrocarbon compositions in the form of crude oils. "Crude oils" as used herein, and in the appended claims, refer to all of the commonly known mineral oils obtained from wells. The benefits obtained from the incorporation of the mixed alkyl esters described above particularly are evident when the esters are incorporated into very high wax-containing crude oils having high boiling points and pour points above about 25° C. North African crude oils designated as Zelten, Indian crudes and Indonesian crudes are examples of waxy crude oils which can be treated with the mixed alkyl esters described above to improve the flow properties.

The amount of mixed alkyl ester that will be used to improve the flow properties of the crude oils generally will be that amount which is effective to provide the desired changes in the flow properties of the crude oil. This amount will depend on certain factors including the concentration and nature of the wax in the crude, and the lowest temperature that will be attained by the crude oil during the time that flowability is important. This amount can be readily determined by adding increasing amounts of the mixed alkyl ester to samples of crude oil, adjusting the temperature to the lowest temperature to be attained by the crude, and noting the concentration at which wax crystallization no longer occurs. This amount generally will range from at least about 0.001% by weight to as high as about 1 or 2% by weight. Generally, however, a range of from about 0.003 to about 0.01 or even 0.3% by weight is sufficient to impart a desired level of flow improvement and pour point depressancy to the crude oils. Higher levels, e.g., 1.0% or higher can be used but these levels are uneconomic.

The mixed alkyl esters can be fluidized in solvent or diluent carriers. The combination of one or more fluidized mixed alkyl esters and a solvent or diluent carrier is referred to herein as a concentrate composition. The concentrate compositions of this invention are especially advantageous for storing, transport and addition of the mixed alkyl ester to crude oils. The mixed alkyl ester can comprise up to about 80% or higher by weight of the total concentrate composition, more ususually from about 20% to about 50% by weight, of the total weight of the concentrate composition.

The terminology "fluidized" as used herein is intended to refer to solutions, suspensions or emulsions of the mixed alkyl ester in solvent or diluent carriers. While some settling or separation over a period of time of the fluidized mixed alkyl ester normally can be tolerated in the concentrate compositions contemplated herein, it is usually preferred that most of the mixed alkyl ester either be dissolved, or uniformly dispersed in the form of a stable suspension, in the solvent or diluent carrier. The fluidized nature of the mixed alkyl ester in the solvent or solvent carrier will be readily apparent to those in the art.

The balance of the concentrate composition, i.e., the solvent or diluent carrier, is normally comprised of one or more normally liquid solvents or diluents, referred to herein as solvent or diluent carriers. These solvents or diluents are substantially inert, (i.e., do not react with the mixed alkyl ester or the oil to which it is to be added, to any appreciable extent) normally liquid, organic materials. The solvent or diluents can be selected from a wide range of materials and may include unreacted monohydric alcohols and reaction media, as above described, low boiling solvents, mineral oils, and the like. Also, the particular crude oil to which the concentrate is to be added may also be used alone or in combination as a solvent or diluent carrier. Most usually, combinations of these solvent or diluent carriers will be employed. Examples of low boiling solvent or diluent carriers include aromatic hydrocarbons, aliphatic hydrocarbons, chlorinated hydrocarbons, ethers, alcohols and the like such as benzene, toluene, xylene, heptane, octane, dodecane, cyclohexane, methylcyclohexane, kerosene, chlorobenzene, heptyl chloride, 1,4-dioxane, npropyl ether, cyclohexanol, ethyl n-amyl ether as well as mixtures of two or more of these. Typically useful solvent or diluent carriers are xylene, toluene, mineral oil and combinations thereof. The concentrate may contain other additives such as rust inhibitors, antioxidants, and the like which are desired to be incorporated into the crude oils. These additional additives and their formulations into oil compositions are well known in the art.

In accordance with this invention, the flow properties of crude oils are improved by the addition thereto of a small amount of a mixed alkyl ester in fluidized form as described above. In one preferred embodiment, a mixed alkyl ester such as the ester of Example 2 is dissolved in mineral oil to provide a solution containing about 60% mineral oil. Alternatively, the mineral oil may be replaced by a more volatile hydrocarbon solvent such as xylene. When the mixed alkyl esters described above are incorporated into crude oils in sufficient amounts, the pour point, plastic viscosity and yield value of the crude oil, particularly the high wax or waxy crude oils, are reduced significantly. The reduction in the values for these properties indicates a treated crude oil having improved flow properties. The pour point of both treated and untreated crude oils can be determined by ASTM procedure D 97. Plastic viscosity and yield values of treated and untreated crude oil samples can be determined using the FANN viscometer (Model 35A with SI12 gear box) fitted with rotor, bob and spring. Plastic viscosity and yield values are important properties since these are measures of the deviation from Newtonian flow for a given fluid.

What is claimed is:

1. A crude oil composition having a minor amount of at least one mixed alkyl ester made by reacting;

(A) interpolymers having a RSV in a range from about 0.1 to about 2.0 which contain units derived from (i) at least one $\alpha,\beta$-unsaturated dicarboxylic acid, or derivative thereof and (ii) one or more vinyl aromatic monomers having up to about 12 carbon atoms, the molar ratio of (i) to (ii) being from about 1:1 to about 1:3, with (B) a mixture of two or more monohydric alkanols containing from 18 to 40 carbon atoms, at least one of the alkanols containing 18 carbon atoms.

2. The composition of claim 1, wherein (i) is maleic acid, fumaric acid, a lower alkyl ester of one of these acids or maleic anhydride.

3. The composition of claim 1 wherein the vinyl monomer is a styrene.

4. The composition of claim 1, wherein the interpolymer (A) has a RSV in a range of from about 0.3 to about 1.8.

5. The composition of claim 4, wherein (i) is maleic anhydride; (ii) is styrene; and the alkanol mixture contains 18 to 24 carbon atoms.

6. The composition of claim 5, wherein the molar ratio of (i) to (ii) is about 1:1.

7. A crude oil composition having a minor amount of at least one mixed alkyl ester made by reacting (A) one equivalent of an interpolymer having a RSV in a range of from about 0.3 to about 1.8 which contains units derived from (i) fumaric acid, maleic acid, a lower alkyl ester of one of these acids, maleic anhydride, or mixtures of two or more of these and (ii) a vinyl aromatic compound having up to about 12 carbon atoms, the molar ratio of (i) to (ii) being from about 1:1 to about 1:3, with (B) at least one equivalent of a mixture of monohydric alkanols containing from 18 to 40 carbon atoms, at least one of the alkanols containing 18 carbon atoms.

8. The composition of claim 7, wherein (i) is maleic anhydride and (ii) is styrene, the molar ratio of units of (i) to (ii) being about 1:1.

9. A composition according to any of claims 1–8 wherein the amount of $C_{18}$ alkanol in (B) is about 15–40 mole percent.

* * * * *